US011135461B2

(12) United States Patent
Beechy et al.

(10) Patent No.: US 11,135,461 B2
(45) Date of Patent: Oct. 5, 2021

(54) FIRE SUPPRESSION SYSTEM COMPONENT INTEGRATION

(71) Applicant: Akron Brass Company, Wooster, OH (US)

(72) Inventors: David Beechy, Sugarcreek, OH (US); Jerry A. Christensen, Wooster, OH (US); Bradley L. Busch, Ocala, FL (US); Peter J. Lauffenburger, Orrville, OH (US)

(73) Assignee: AKRON BRASS COMPANY, Wooster, OH (US)

( * ) Notice: Subject to any disclaimer, the term of this patent is extended or adjusted under 35 U.S.C. 154(b) by 1238 days.

(21) Appl. No.: 14/877,387

(22) Filed: Oct. 7, 2015

(65) Prior Publication Data

US 2016/0096053 A1 Apr. 7, 2016

Related U.S. Application Data

(60) Provisional application No. 62/060,875, filed on Oct. 7, 2014.

(51) Int. Cl.

| | |
|---|---|
| ***A62C 37/36*** | (2006.01) |
| ***A62C 35/68*** | (2006.01) |
| *A62C 5/02* | (2006.01) |

(52) U.S. Cl.

CPC ..... *A62C 35/68* (2013.01); *A62C 37/36* (2013.01); *A62C 5/02* (2013.01)

(58) Field of Classification Search

CPC ..... A62C 35/68; A62C 37/36; A62C 5/02; A62C 27/00; A62C 31/12

(Continued)

(56) References Cited

U.S. PATENT DOCUMENTS

| | | | |
|---|---|---|---|
| 1,725,273 | A | 8/1929 | Hollander et al. |
| 3,997,282 | A | 12/1976 | Thomas et al. |

(Continued)

OTHER PUBLICATIONS

PCT International Search Report and Written Opinion from International Application No. PCT/US2015/0054471, dated Jan. 5, 2016, 10 pages.

(Continued)

*Primary Examiner* — Joseph A Greenlund

(74) *Attorney, Agent, or Firm* — Tucker Ellis LLP; Michael G. Craig

(57) ABSTRACT

One or more techniques and/or systems are disclosed for a substantially automated fire suppression system, based on a distributed control communications network. The distributed system can comprise a communication network and at least two control components that are communicatively coupled with the communication network. A first control component can perform a first fire suppression operation, transmit first fire suppression operation data to the communication network, and receive second fire suppression operation data from the communication network. A second control component can perform a second fire suppression operation, transmit second fire suppression operation data to the communication network, receive first fire suppression operation data from the communication network, and alter the second fire suppression operation based at least upon the received first fire suppression operation data.

14 Claims, 7 Drawing Sheets

(58) Field of Classification Search
USPC ..... 169/24, 46
See application file for complete search history.

(56) References Cited

U.S. PATENT DOCUMENTS 4,189,005 A * 2/1980 McLoughlin ..... A62C 27/00 169/13
4,492,525 A 1/1985 Bilyeu
5,846,085 A 12/1998 Witt, III
6,547,528 B1 4/2003 Yoshida
7,040,868 B2 5/2006 McLaughlin et al.
7,107,129 B2 * 9/2006 Rowe ..... F41A 27/26 701/1
7,234,922 B2 6/2007 Kunkler et al.
7,255,539 B1 8/2007 Kunkler et al.
7,739,921 B1 6/2010 Babcock
7,849,871 B2 12/2010 McLoughlin et al.
7,987,916 B2 * 8/2011 Laskaris ..... A62C 35/026 169/24
8,162,619 B2 4/2012 Laskaris
8,376,719 B2 2/2013 Grady et al.
8,378,834 B1 2/2013 Glaub et al.
8,418,773 B2 * 4/2013 Cerrano ..... A62C 37/00 169/46
8,517,696 B2 8/2013 McLoughlin et al.
8,662,856 B2 * 3/2014 Christensen ..... F04B 17/05 417/28
9,120,570 B2 * 9/2015 Hoisington ..... A62C 3/0235
9,619,996 B1 * 4/2017 Smith ..... H04Q 9/00
9,744,388 B2 * 8/2017 Ewers ..... A62C 31/12
2003/0210984 A1 11/2003 Whitney
2004/0019414 A1 * 1/2004 Pillar ..... B60R 16/0315 701/2
2004/0056765 A1 * 3/2004 Anderson ..... A62C 99/0045 340/522
2004/0188164 A1 * 9/2004 Maeno ..... B60R 25/305 180/287
2004/0199302 A1 * 10/2004 Pillar ..... B65F 3/045 701/1
2006/0131038 A1 6/2006 Lichtig
2006/0180321 A1 8/2006 Yoshida
2007/0164127 A1 7/2007 Lozier et al.
2008/0041599 A1 2/2008 Mulkey et al.
2008/0215190 A1 * 9/2008 Pillar ..... B60T 17/221 701/1
2008/0215700 A1 * 9/2008 Pillar ..... G08G 1/20 709/212
2009/0208346 A1 8/2009 McLoughlin et al.
2009/0315726 A1 12/2009 Popp et al.
2011/0064591 A1 3/2011 McLoughlin et al.
2011/0187524 A1 * 8/2011 Cochran, III ..... G08B 1/08 340/539.1
2011/0308823 A1 * 12/2011 Seebaluck ..... A62C 99/0018 169/46
2013/0048318 A1 * 2/2013 Ewers ..... A62C 31/12 169/46
2013/0098642 A1 * 4/2013 McLoughlin ..... F04B 17/05 169/43
2013/0105010 A1 * 5/2013 McLoughlin ..... A62C 31/12 137/557
2013/0105182 A1 * 5/2013 McLoughlin ..... G05D 9/12 169/46
2013/0186651 A1 * 7/2013 Cerrano ..... G05D 7/0635 169/16
2013/0186653 A1 7/2013 Cerrano
2013/0253711 A1 * 9/2013 McLoughlin ..... F04B 17/06 700/282
2014/0069665 A1 3/2014 Fernstrum et al.
2014/0081479 A1 * 3/2014 Vian ..... G06Q 10/06 701/2
2014/0358367 A1 * 12/2014 Copeland ..... B60R 16/03 701/36
2015/0339863 A1 * 11/2015 Allwardt ..... G07C 5/08 701/31.5
2016/0096053 A1 * 4/2016 Beechy ..... A62C 37/36 169/46
2016/0096054 A1 * 4/2016 Busch ..... H04L 67/125 700/282
2018/0169450 A1 * 6/2018 Moffa ..... A62C 37/50

OTHER PUBLICATIONS

Hale Prodcuts, Sentry Pressure Governor System, 20 pages.

* cited by examiner

FIRE SUPPRESSION SYSTEM COMPONENT INTEGRATION

CROSS-REFERENCE TO RELATED APPLICATIONS

This application claims priority to U.S. Provisional Patent Application Ser. No. 62/060,875, entitled FIRE SUPPRESSION SYSTEM COMPONENT INTEGRATION, filed Oct. 7, 2014, which is incorporated herein by reference.

BACKGROUND

Fire suppression systems comprise various forms, from mobile systems to stationary single purpose systems. Commonly, a truck mounted system is used and transported to an incident scene to provide fire suppression operations. Truck mounted systems often comprise a plurality of components used to provide fire suppression operations, such as valves, pumps, power provider, hoses, nozzles and other fluid discharge devices.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

As provided herein, a plurality of fire suppression components can be integrated together to form a substantially automated fire suppression system, based on a distributed control communications network. A fire suppression control component may be added to the distributed control communications network to provide additional functionality for the system; or, a fire suppression control component can be subtracted from the network when it is no longer needed, for example. As an example, a fluid source valve and a fluid discharge component, such as a hose nozzle, with a control valve disposed between, respectively coupled with a distributed communication network, may comprise a substantially automated system.

In one implementation, a fire suppression system utilizing distributed control can comprise a communication network. Further, the system may comprise at least two control components, a first control component and a second control component, which are communicatively coupled with the communication network. In this implementation, the first control component can be configured to perform a first fire suppression operation, transmit first fire suppression operation data to the communication network, and receive second fire suppression operation data from the communication network. Additionally, the second control component configured to perform a second fire suppression operation, transmit second fire suppression operation data to the communication network, receive first fire suppression operation data from the communication network, and alter the second fire suppression operation based at least upon the received first fire suppression operation data.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1:
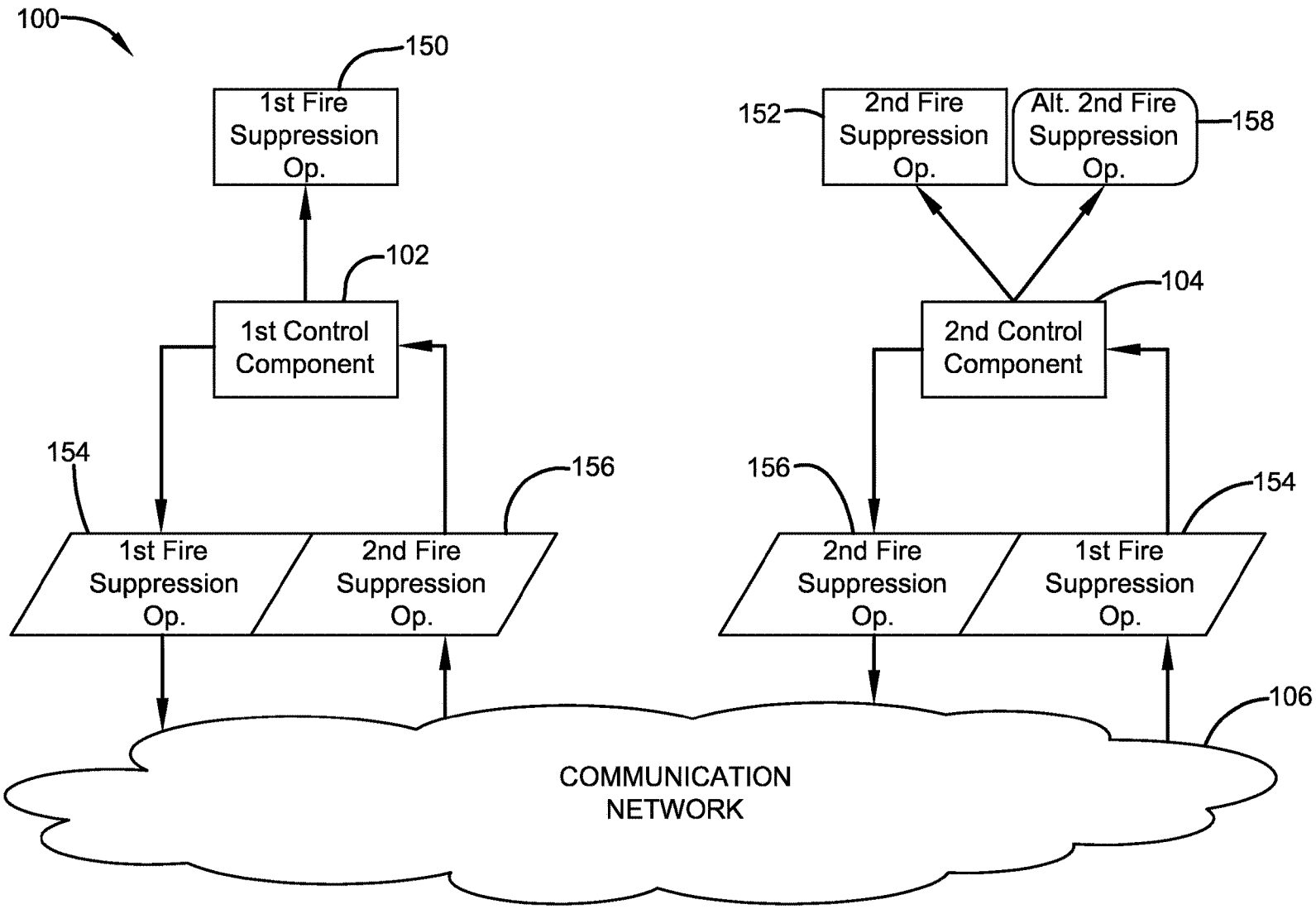
FIG. 1 is a schematic diagram illustrating an exemplary implementation of a fire suppression system that utilizes a distributed network.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices may be shown in block diagram form in order to facilitate describing the claimed subject matter.

In one aspect, a fire suppression system can comprise a plurality of components that are integrated together to form the system. As an example, in this aspect, additional components may be added to provide additional functionality for the system. Often, a fire suppression system comprises a fluid source (e.g., water source) and a fluid discharge component, such as a hose nozzle, with a control valve disposed between the fluid source and discharge component. In this aspect, for example, one or more components may be operably engaged with the system to provide more functionality, such as a fluid pump, a storage tank, additional valves, etc.

FIG. 1 is a schematic diagram illustrating an exemplary implementation of a fire suppression system 100 where a distributed network may be utilized to facilitate control fire suppression components. In this implementation, the exemplary system 100 comprises a communication network 106. The exemplary system 100 comprises a first control component 102 that is communicatively coupled with the communication network 106. The first control component 102 can be configured to perform a first fire suppression operation 150, such as fluid management, fluid discharge, fluid intake control, etc. Further, the first control component 102 can be configured to transmit first fire suppression operation data 154 to the communication network 106. Additionally, the first control component 102 can be configured to receive second fire suppression operation data 156 from the communication network 106.

In the implementation of FIG. 1, the exemplary system 100 comprises a second control component 104 that is communicatively coupled with the communication network 106. The second control component 104 can be configured to perform a second fire suppression operation 152, such as fluid management, fluid discharge, fluid intake control, etc. Further, the second control component 104 can be configured to transmit second fire suppression operation data 156 to the communication network 106. Additionally, the second control component 104 can be configured to receive first fire suppression operation data 154 from the communication network 106. The second control component 104 can also be configured to alter the second fire suppression operation 158 based at least upon the received first fire suppression operation data 154.

Figure 3:
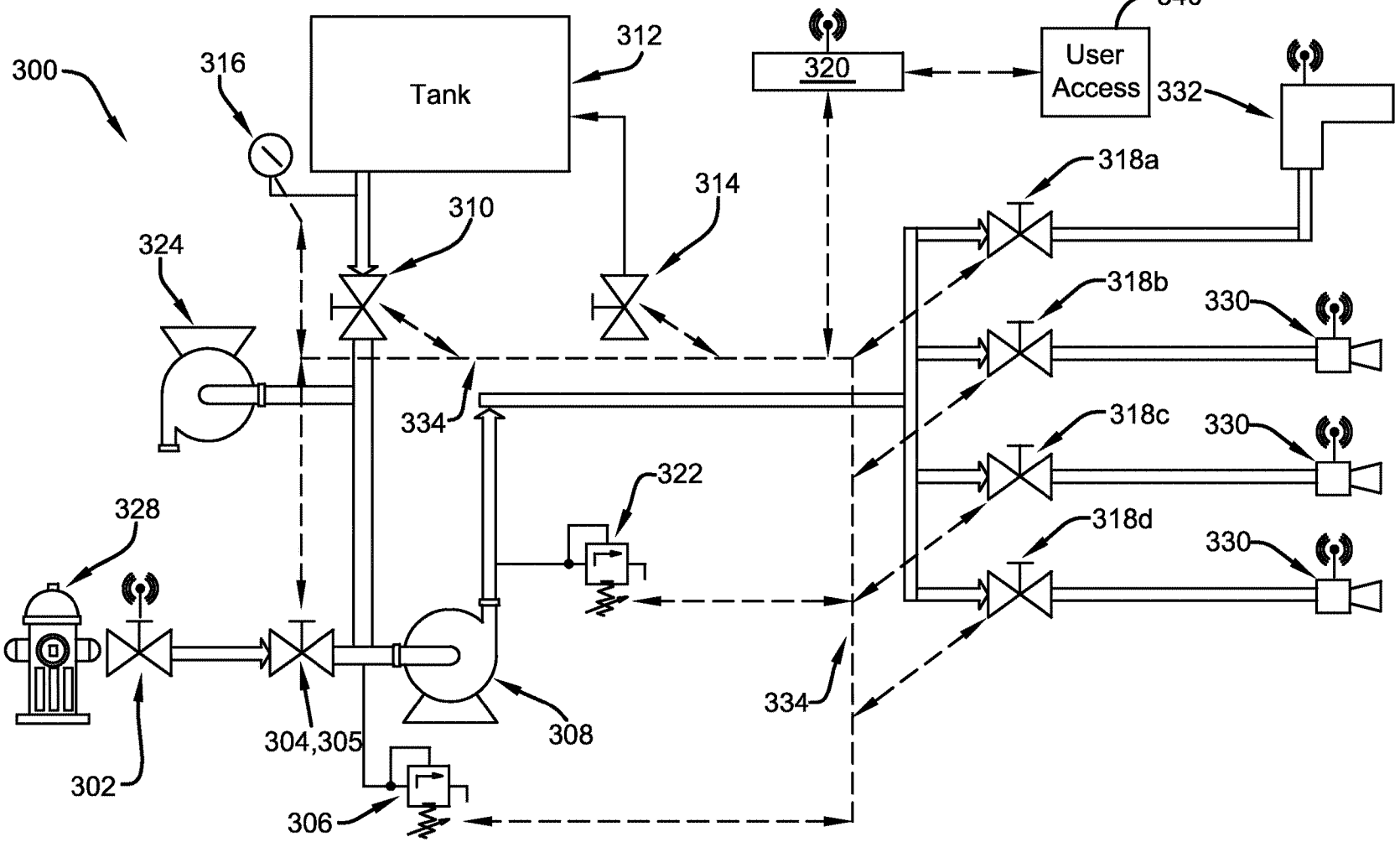
FIG. 3 is a schematic diagram illustrating an example implementation of one or more portions of one or more systems described herein.

As an illustrative example, FIG. 3 is a schematic diagram illustrating an example implementation of a fire suppression system 200 that may utilize a communications network. An example system 300 may comprise a plurality of components, for example, where a distributed communication network could be utilized to facilitate control of the plurality of control components. In FIG. 3, the example fire suppression system 300 comprises a fluid source supply control valve 302. The fluid source supply control valve 302 may be fluidly coupled with a fluid source 328, such as a water supply system (e.g., a fire hydrant or other water supply), or some other fluid supply (e.g., chemical-based treatment fluid) that is appropriate for a target fire. In one implementation, the fluid source supply control valve 302 can comprise a wireless transceiver that is configured to provide wireless communication between the fluid source supply control valve 302 and a wireless network gateway device 320 communicatively coupled with a communication network 334.

In one implementation, the communication network 334 can comprise a bus-type network. For example, a bus network can comprise a linear bus arrangement (e.g., or sequence of buses), to which a plurality of node components may be communicatively coupled, such as in a daisy-chain arrangement. In this way, in this implementation, respective node components can be added to (e.g., or subtracted from) the communication network, resulting in a distributed network of node components. In one example, the communication network 334 can comprise a Controller Area Network (CAN) bus network and respective control components (e.g., nodes) can be communicatively coupled to the CAN. It is anticipated that other types of distributed control network buses may be implemented, such as FlexRay, Local Interconnect Network (LIN), ByteFlight, and others (e.g., SENT, SMB, PMBus, DCC, DMX512-A, PSIS, X10, SIOX, 10Base-2, RS-232, EIA-485, SCSI).

Figure 2:
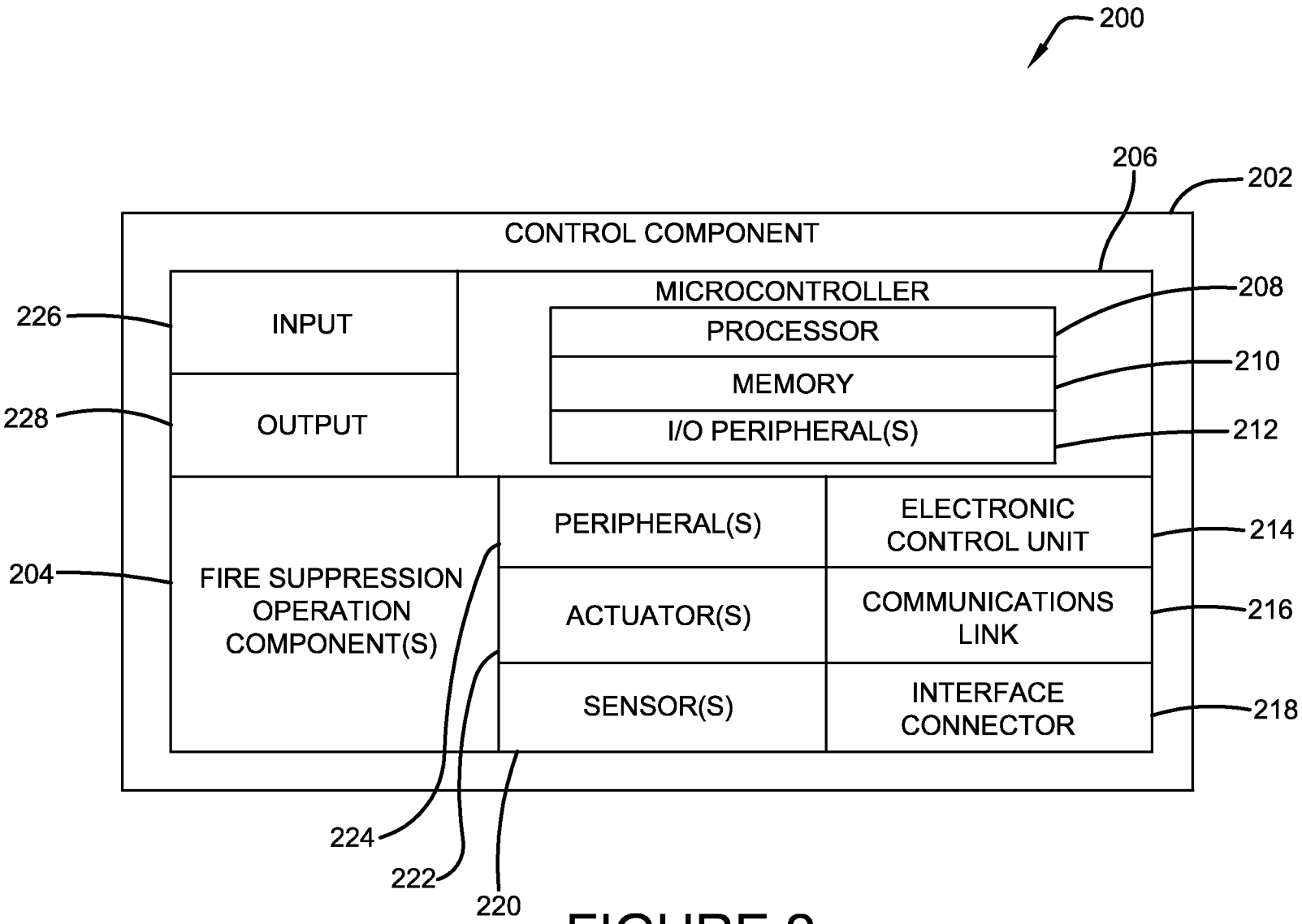
FIG. 2 is a schematic diagram illustrating an example implementation of one or more portions of one or more systems described herein.

In one implementation, as illustrated in the example implementation 200 of FIG. 2, a control component 202 may be communicatively coupled with the communication network (e.g., 106 of FIG. 1, 334 of FIG. 3) using an interface connector 218 (e.g., a network interface controller (NIC), or wireless network interface controller/connector (WNIC)). In one implementation, a control component 202 can be configured to communicate with one or more other control components on the network. As an illustrative example, in FIG. 3, an example system 300 can comprise a plurality of fire suppression components (e.g., 302-318, 322, 324, 330, 336) that comprise control components. In one implementation, respective control component may use the communication network 334 to broadcast a data packet comprising an indication of fire suppression operation data, such as a state of the control component, system operation conditions, and/or a desired system operational demand.

As an example, the communication network 334 can comprise a bus (e.g., wire), which is communicatively coupled to the other control components, which may be configured to receive the broadcast packet. In one implementation, merely a control component that is targeted for the packet (e.g., or a plurality of target control components) may selectively accept and process the data packet. In this example, the non-targeted control components may merely ignore the broadcast data packet.

In one implementation, one or more of the control components may merely receive data packets broadcast on the communication network, for example, and may refrain from broadcasting. As an example, a control component may be configured to populate a database (e.g., table) with data that is indicative of a state of other control component coupled with the network (e.g., based on a network address assigned at power-up).

In one implementation, the example control device may transmit point to point state data, over the communication network, to a target control component listed in the database, based on a request (e.g., command or requested operational condition) or prior received state data. In this way, as one example, a non-configured device (e.g., not specifically configured for the system) can be coupled with the network, but the non-configured device may not be configured to appropriately process data packets that are broadcast on the network. In this implementation, using the information from the database provided by the example control device, the non-configured device may be able to send and/or receive appropriate state data and/or requests.

In one aspect, as illustrated in FIG. 2, a control component 202 may comprise a device or apparatus that provides at least a portion of the operational control to a fire suppression system 204. As an example, a control component may comprise a type of valve, pump, discharge nozzle, governor, sensor, pressure relief device, etc. Further, in this aspect, in one implementation, the control component 202 can comprise one or more portions of an electronic control unit (ECU) 214. For example, the control component may comprise one or more portions of a microcontroller 206 (e.g., a processor core 208, memory 210, and one or more programmable input and/or output peripherals 212), a communications link 216 (e.g., wired and/or wireless, serial communications interfaces), a bus connector 218, and/or some form of housing. In some implementations, the control component 202 may comprise other control related peripherals 224, such as one or more timers, event counters, radio control (RC) circuits, analog-digital converters, and others. Additionally, in some implementations, the control component 202 may comprise sub-components that facilitate performance of the desired function of the controller, such as one or more actuators 222 (e.g., motorized and/or manual), and safety components and sensors 220.

Returning to FIG. 3, in one implementation, the fluid source supply control valve 302 (e.g., a first control component) may be configured to allow an operator to open a valve to the fluid source 328 remotely when the system 300 is prepared for the fire suppression fluid. In this implementation, the fluid source supply control valve 302 control component, for example, can be use to automatically open and close the valve to let fluid flow from the source to the fire suppression system. That is, for example, the fluid source supply control valve 302 control component, when communicatively coupled to the communication network 334 (e.g., wirelessly through a wireless network gateway device 320, or wired), may be able determine when conditions are appropriate for opening the valve to allow fluid to flow to the system 300, automatically. As an example, this may mitigate a need for an onsite operator to manually identify when the system 300 is ready for the fluid and manually open the valve.

In FIG. 3, the example implementation of the fire suppression system 300 can comprise an intake valve 304. An intake valve 304 can be configured to control a flow of fluid from the fluid source 328 into the system 300 (e.g., a mobile or stationary fire suppression system). In one implementation of the fire suppression system 300, when acting as a control component communicatively coupled to the communication network 334, the intake valve 304 can be configured to automatically open when an attached fluid line is appropriately pressurized and automatically close when the line is no longer in use. In this implementation, for example, the intake valve 304 as a control component may reduce the manual tasks associated with operating the fire suppression system 300, creating a more efficient system.

In one implementation, an intake air bleeder valve 305 may be disposed in association with the intake valve 304. An intake air bleeder valve 305 can be configured to bleed air from a coupled fluid line at the line is filled with the fluid. In one implementation of the fire suppression system 300, when acting as a control component communicatively coupled to the communication network 334, the intake air bleeder valve 305 can be configured to automatically open to bleed air from a coupled fluid line and automatically close when the line is filled with the fluid to a desired level. In this implementation, for example, the intake air bleeder valve 305 as a control component may reduce the manual tasks associated with setting up the fire suppression system 300 and mitigate a potential that an important set-up step is missed, thereby improving a function of the system 300.

In one implementation, when at least two control components are coupled with the communication network 334, respective components (e.g., a first control component and a second control component) can communicate data, comprising fire suppression operation data, to the each other, where the data may be utilized to modify operational controls of the respective control components. As an example, when the fluid source supply control valve 302, intake valve 304, and intake air bleeder valve 305 are communicatively coupled with the communication network 334, the respective control components (e.g., 302, 304, 305) may communicate state data (e.g., comprising information indicative of the state of the control component, a system operational condition at the control component, and/or a desired system operational demand) to the communication network 334, which may be received by one or more of the other components, and used to modify their operation.

In one implementation, the fluid source supply control valve 302 may utilize the following state data: a state of a fluid line fluidly coupled to the valve (e.g., yes or no); sufficient inlet pressure present (e.g., yes or no); a state of a fluid line fluidly coupled to the intake valve 304 (e.g., yes or no); and/or a state of the intake valve 304 (e.g., closed, fully open, degrees or percentage open). Further, in one implementation, the fluid source supply control valve 302 may provide the following state data (e.g., to the communication network 334): state of the valve (e.g., closed, fully open, degrees or percentage open); inlet pressure; state of fluid line attached to valve (e.g., yes or no).

In one implementation, the intake valve 304 may utilize the following state data: a state of a fluid line fluidly coupled to the valve (e.g., yes or no); sufficient inlet pressure present (e.g., yes or no); state of a fluid source 328 (e.g., present, not present); and/or state of a power source (e.g., power output). Further, in one implementation, the intake valve 304 may provide the following state data (e.g., to the communication network 334): state of the valve (e.g., closed, fully open, degrees or percentage open). Additionally, in one implementation, the intake air bleeder valve 305 may utilize the following state data: state of fluid line fluidly coupled to both the fluid source supply control valve 302 and intake valve 304 (e.g., yes or no); pressure in coupled fluid line; and/or state of fluid present in fluid line (e.g., present, not present). The intake air bleeder valve 305 may also provide state data regarding an opened/closed state to the communication network 334.

In this implementation, for example, the respective control components (e.g., 302, 304, 305) can provide the state data (e.g., first fire suppression operation data, and second fire suppression operation data) to the communication network 334 and transmitted state data may be received by the respective control components coupled with the communication network. As an example, data indicative of a fluid line coupled with both the fluid source supply control valve 302 and intake valve 304 can be received by the intake air bleeder valve 305. In this example, the intake air bleeder valve 305 may utilize this data to alter an operational condition of the bleeder valve 305, such as by opening the valve to bleed air from the coupled line. As another example, data indicative of a fluid line coupled with the intake valve 304 can be received by the fluid source supply control valve 302. In this example, in combination with other received state data, the fluid source supply control valve 302 may utilize the data to cause the valve to open to allow a fluid to flow into the system.

In FIG. 3, the example implementation of the fire suppression system 300 can comprise an intake relief valve 306. An intake relief valve 306 can be configured to mitigate excessive pressure build up between the intake valve 304 and a main pump 308, which may result in an over pressurization of a fluid discharge line in the system 300. In one implementation of the fire suppression system 300, when acting as a control component communicatively coupled to the communication network 334, the intake relief valve 306 can be configured to automatically adjust to a desired pressure setting, for example, such as a predetermined pressure setting and/or a pressure setting dictated by a pressure governor coupled with the system 300. As one example, the intake relief valve 306 may facilitate safety to personnel and equipment by mitigating over-pressurization related problems by opening to release fluid from the system. In one implementation, the intake relief valve 306 may utilize state data that identifies whether the inlet pressure is greater that a desired setting (e.g., a pressure governor setting) (e.g., yes or no). Additionally, the intake relief valve 306 may provide state data about the relief valve regarding an opened/closed state to the communication network 334.

In FIG. 3, the example implementation of the fire suppression system 300 can comprise a tank to pump valve 310. A tank to pump valve 310 can be configured to control a flow of the fluid into the system from a fluid storage tank 312. In one implementation of the fire suppression system 300, when acting as a control component communicatively coupled to the communication network 334, the tank to pump valve 310 can be configured to recognize when an alternate source for the fluid is not providing fluid to the system and automatically open the valve to provide fluid from the fluid storage tank 312. Further, the tank to pump valve 310 can be configured to recognize when an alternate source for the fluid is providing fluid to the system and automatically close the valve.

As one example, the tank to pump valve 310 can be used to automatically mitigate loss of fluid to the system by directing fluid from the tank 312 when fluid is not being supplied by the fluid source 328. In this way, for example, the fluid supply may not need to be constantly monitored by an operator. In one implementation, the tank to pump valve 310 may utilize state data that identifies whether there is fluid available through the intake valve 304; and/or whether there is sufficient inlet pressure from the fluid source 328. Additionally, the tank to pump valve 310 may provide state data about the tank to pump valve regarding its position (e.g., open, closed, partially open); and/or a flow (e.g., flow rate and/or flow pressure) from the fluid tank 312.

In FIG. 3, the example implementation of the fire suppression system 300 can comprise a pump to tank (e.g., refill) valve 314. A pump to tank valve 314 can be configured to control a flow of fluid into the fluid storage tank 312 from the system, thereby allowing the tank 312 to refill from the fluid source 328. In one implementation of the fire suppression system 300, when acting as a control component communicatively coupled to the communication network 334, the pump to tank valve 314 can be configured to automatically open to provide for refilling of the fluid storage tank from the system, when the fluid source 328 is providing fluid to the system. Further, the pump to tank valve 314 can be configured to automatically close when a tank level sensor 316 identifies that the fluid storage tank 312 has reach a desired fill level (e.g., depending on operational conditions of the fire suppression system and/or a demand of fluid for the fire suppression operations).

As one example, the pump to tank valve 314 can be used to automatically provide for refilling the fluid storage tank 312 when conditions are appropriate for drawing fluid from the system, thereby mitigating a need for an operator to constantly monitor fluid levels in the tank, and system operational conditions. In one implementation, the pump to tank valve 314 may utilize state data that identifies whether there is sufficient inlet pressure; whether the fill level of the tank is at a desired level; whether the system is capable of pumping additional fluid; and/or a temperature of the main pump 308 (e.g., for cooling purposes). Additionally, the pump to tank valve 314 may provide state data about the pump to tank valve regarding a flow (e.g., flow rate and/or flow pressure) to the fluid storage tank 312.

In FIG. 3, the example implementation of the fire suppression system 300 can comprise a discharge valve 318*a*, 318*b*, 318*c*, 318*d*. A discharge valve 318 can be configured to control a discharge of fluid from the system to a discharge component 330, 332 (e.g., nozzle 330, monitor 332). In one implementation of the fire suppression system 300, when acting as a control component communicatively coupled to the communication network 334, the discharge valve 318 can be configured to automatically regulate a position of the valve (e.g., open, closed, partially open), for example, in order to maintain a desired flow (e.g., flow rate and/or flow fluid pressure). The discharge valve 318 may also be configured to transmit data to the communication network 334 that is indicative of a signal identifying that the valve is open but a desired flow has not been attained. In one implementation, the data indicative of the signal may be received by a pressure governor, which can provide for an increase in pump operation, for example, to increase fluid flow in the system, if available.

As an example, the discharge valve 318 can be used to automatically maintain a desired flow to the discharge component(s) 330, 332, depending on fluid flow conditions in the system. In this example, the discharge valve 318 may be able to monitor flow demand at the discharge component(s) 330, 332 (e.g., based on an open condition at the discharge component, and/or input demand provided by a discharge component operator), and automatically adjust the valve position (e.g., open, closed, partially opened) based on the operational conditions. The ability to automatically adjust flow based on conditions and/or demand may mitigate a need to have an operator monitor conditions and adjust the valve to meet demand, for example.

In one implementation, the discharge valve 318 can utilize state data that identifies a flow demand (e.g., from the discharge component); and/or identifies a desired flow for the operational conditions (e.g., flow rate and/or flow fluid pressure). Additionally, the discharge valve 318 can provide state data about the discharge valve regarding a valve position (e.g., open, closed, partially open); a mode of operation; a fluid flow rate; a fluid flow pressure; and/or whether a desired flow set point has been achieved.

In FIG. 3, the example implementation of the fire suppression system 300 can comprise a pump outlet relief valve 322. A pump outlet relief valve 322 can be configured to relieve pressure from the main pump 308 if the pump becomes over pressurized, for safety of the pump and/or personnel. In one implementation of the fire suppression system 300, when acting as a control component communicatively coupled to the communication network 334, the pump outlet relief valve 322 can be configured to automatically adjust a desired pressure relief setting based on setting provided by a pressure governor coupled with the system. Further, the pump outlet relief valve 322 can be configured to automatically self-flush, for example, when operational conditions are appropriate for this operation. As an example, the pump outlet relief valve 322 can be used to automatically maintain a safe pressure relief setting based on the pressure governor, so that an operator does not need to manually adjust the setting. In one implementation, the pump outlet relief valve 322 can utilize state data that identifies the pressure setting of the pressure governor. Additionally, the pump outlet relief valve 322 can provide state data about the pump outlet relief valve regarding its position (e.g., open, closed).

In FIG. 3, the example implementation of the fire suppression system 300 can comprise a priming pump 324. A priming pump 324 can be configured to draw water into the intake line of the system, such as from the fluid source 328 and/or the fluid storage tank 312. In one implementation of the fire suppression system 300, when acting as a control component communicatively coupled to the communication network 334, the priming pump 324 can be configured to automatically run at least until the fluid is drawn into the system (e.g., the fluid is being pumped), for example, when an inlet line is coupled to the fluid source 328. As an example, if a vacuum is present, or line pressure is present, the priming pump 324 may automatically operate to draw fluid into inlet line, at least until a desired fluid flow or pressure is attained. In this way, for example, a substantially constant flow of a desired amount of fluid can be maintained. In one implementation, the priming pump 324 can utilize state data that identifies whether an inlet line is fluidly coupled with the fluid source 328; and/or whether a vacuum or fluid pressure level is present in the line. Additionally, the priming pump 324 can provide state data regarding whether fluid is being pumped.

In FIG. 3, the example implementation of the fire suppression system 300 can comprise a wireless network gateway device 320 that is configured to provide wireless communication between the communication network 334 and a control component (e.g., 302, 330, 332) that is engaged with the fire suppression system 300. In one implementation, the wireless network gateway device 320 can receive data from one or more wireless control components, for example, indicative of their respective state information, and provide the received data to the communication network 334. Further, the wireless network gateway device 320 can transmit data from the communication network 334, indicative of state information from one or more control components coupled with the communication network 334, to the one or more wireless control components. As an example, a wireless control component may comprise a component that is engaged with the fire suppression system 300, such as a remote nozzle or monitor (e.g., portable monitor), which cannot couple with the communication network 334 via a wired connection (e.g., due to remoteness, safety, and/or damage hazards).

In FIG. 3, the example implementation of the fire suppression system 300 can comprise one or more discharge nozzles 330. A discharge nozzle 330 can be configured to control a flow and/or pattern of a discharged extinguishing agent, comprising the fluid. Further, the discharge nozzle 330 can be configured to convert fluid pressure into velocity of fluid delivery; can provide a means to change a shape of the fluid stream; and/or determine a flow-pressure relationship. In one implementation of the fire suppression system 300, when acting as a control component communicatively coupled (e.g., wirelessly) to the communication network 334, the discharge nozzle 330 can be configured to determine whether a requested flow (e.g., flow rate and/or flow fluid pressure) has been attained; automatically adjust flow based on current flow, flow demand, site conditions, and/or system operational conditions; alert an operator if/when the desired flow has been attained; alert the operator when the system's operational conditions may not allow for the requested flow to be attained; identify whether a heat load of a target fire is reducing when the nozzle is operational; and/or request additional flow if the heat load is not reducing, or is unchanged.

As an example, the discharge nozzle may be used to help the operator identify flow and request additional flow based on site conditions. Further, the discharge nozzle may help the operator know if the flow has been attained, in order to determine whether the desired flow meets the needs of the site conditions. Additionally, using the heat sensing capabilities, for example, the flow can be automatically adjusted to meet site conditions, allowing the operator to focus on other aspects of the site conditions. In this implementation, the control component (e.g., the discharge nozzle) can comprise one or more sensors configured to detect desired conditions (e.g., flow rate, temperature, position, location, etc.).

In one implementation, the discharge nozzle 330 can utilize state data that identifies current heat conditions; an operational flow of the system (e.g., from the pressure governor); a pressure demand state of the system (e.g., can more demand be met); and/or a flow from the line coupled with the nozzle (e.g., at the discharge valve 318). Additionally, the discharge nozzle 330 can provide state data regarding the position of the nozzle valve (e.g., open, closed, partially open); a flow magnitude; a mode of operation (e.g., shape and/or velocity of fluid stream); and/or a desired flow demand.

In FIG. 3, the example implementation of the fire suppression system 300 can comprise one or more monitors 332 (e.g., portable, stationary, mounted). A monitor 332 can be configured to act as a discharge outlet (e.g., much like a nozzle), as an extension to a hand-line, and as an unmanned discharge station. In one implementation of the fire suppression system 300, when acting as a control component communicatively coupled (e.g., wirelessly) to the communication network 334, the monitor 332 can be configured to provide similar fire suppression operations as the discharge nozzle 330; however, the monitor 332 may not need to be manned during operation, and may provide additional shut-off capabilities separate from the discharge nozzle 330.

In one implementation, as illustrated in FIG. 3, an example system 300 can comprise a user access control component 340 (e.g., third control component), that is configured to receive fire suppression operation data from the communication network 334, and to receive user input. As an example, the user access control component 340 can comprise a remote component that is wirelessly (e.g., or wired) coupled to the communications network 334, such as through the wireless gateway component 320. Further, in this example, the user access control component 340 can comprise a display that displays fire suppression operational data to a user, and a means for user input. In this way, for example, a current status of the fire suppression operations may be identified by the user, and the user may input desired operational parameters into the system, which may provide request data to one or more control components on the communications network 334.

For example, the user may identify that one or more of the discharge components 330, 332 are not provided with sufficient fluid pressure to accomplish a desired fire suppression task. In this implementation, the user can input updated fluid pressure parameters that provide for a request that the pressure governor provide more pumping power, one or more of the manifold valves open further, and the recirculation valve be restricted. In this implementation, the user access control component 340 can be configured to transmit third fire suppression operation data to the communication network, where the third fire suppression operation data comprises data indicative a request for an alteration of a control component based upon fire suppression operation data received from the communication network, and/or a request for an alteration of a control component based upon received user input.

Figure 4:
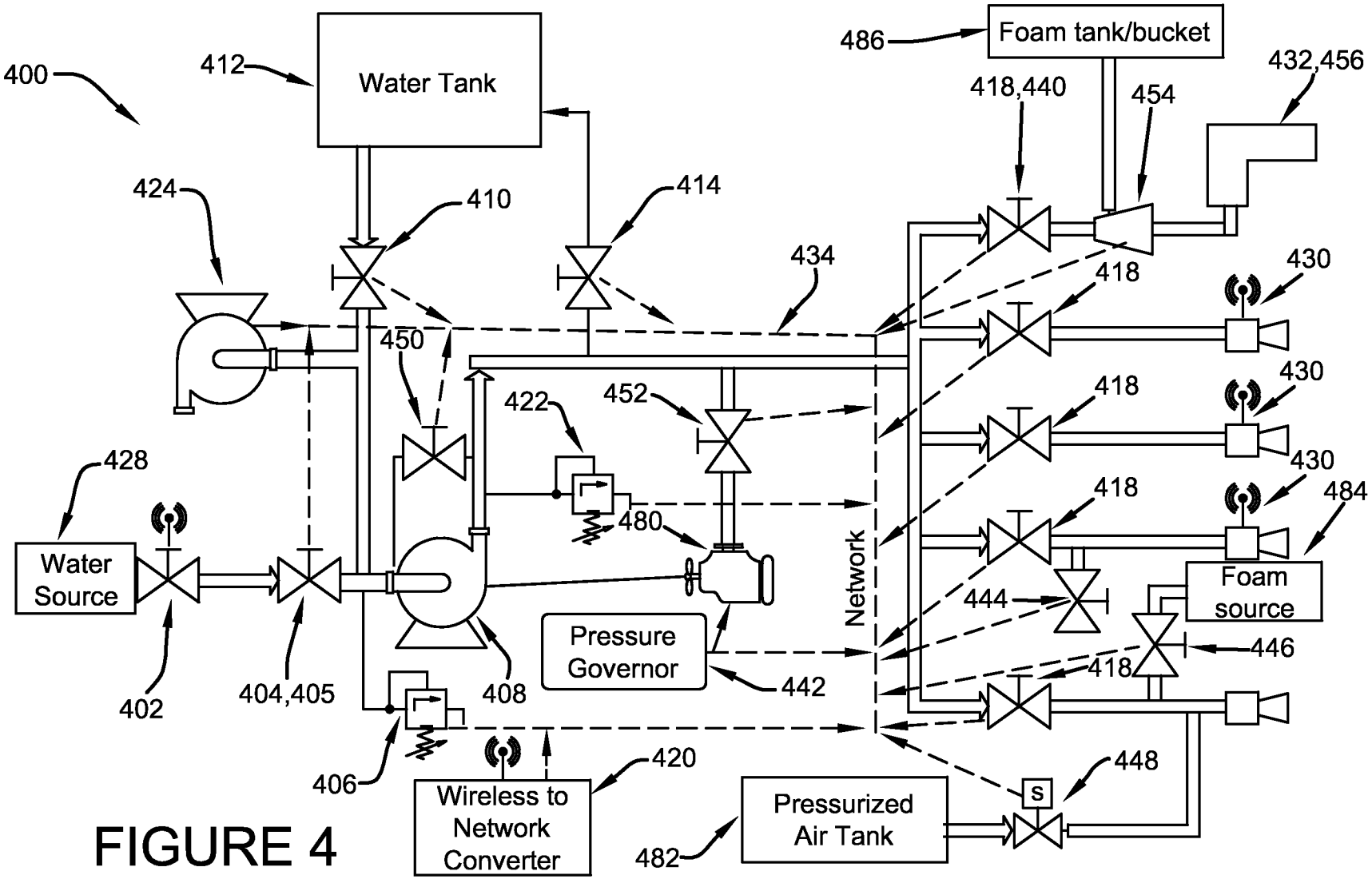
FIG. 4 is a schematic diagram illustrating an example implementation of one or more portions of one or more systems described herein.

In one aspect, a fire suppression system may comprise other control components. FIG. 4 illustrates an example of an alternate implementation of a fire suppression system 400. In this implementation 400, an aerial waterway valve 440 may be operably coupled with the fire suppression system 400. An aerial waterway valve 440 can be configured to control a flow of fluid to an aerial waterway. In one implementation of the fire suppression system 400, when acting as a control component communicatively coupled to the communication network 434, the aerial waterway valve 440 can be configured to automatically regulate a valve position, for example, to maintain a desired flow (e.g., rate, pressure). Further, the aerial waterway valve 440 can be configured to transmit a signal to the communication network 434 if the valve is disposed in an open position, and a desired flow is not being attained at the aerial waterway valve 440. Additionally, the aerial waterway valve 440 can be configured to limit a flow as the aerial waterway valve 440 is extended further away from the system 400 (e.g., on a ladder or crane arm), for example, which may mitigate flow to a desired rate or pressure, based on an algorithm, as the aerial position is extended.

As an example, the aerial waterway valve 440 may be used to maintain a desired flow of fluid to an aerial waterway, such as under operational conditions when a pressure governor 442 is set to a higher pressure than desired on the discharge line. A nozzle operator typically desires a substantially constant flow of fluid during firefighting operations; the use of the aerial waterway valve 440 may mitigate a need for an operator to monitor discharge pressure and adjust the pressure governor to meet demand or operational conditions. Further, for example, the aerial waterway valve 440 may be used to maintain a flow (e.g., along with force on the aerial discharge) within desired (e.g., appropriate operational) limits; while mitigating a potential for a main pump creating an elevated flow when the aerial is extended.

In one implementation, the aerial waterway valve 440 can utilize state data (e.g., from the communication network 434, or one or more internal sensors) that identifies a current demand for flow; a desired flow rate setting; a desired fluid pressure setting; environmental conditions; location; and/or a position (e.g., extended, retracted, partial, elevation, angle) of the aerial discharge. Additionally, the aerial waterway valve 440 can provide state data (e.g., to the communication network 434) regarding the position of the valve (e.g., open, closed, partially open); a mode of operation; a current flow rate; a current fluid pressure; whether a desired flow set point has been attained; and/or a desired flow limit value.

In FIG. 4, the example implementation of the fire suppression system 400 can comprise a pressure governor 442. A pressure governor 442 can be configured to control the speed (e.g., revolutions per minute (RPMs) or equivalent) of a fire suppression system engine 480 (e.g., truck/trailer mounted, portable, or stationary). A pressure governor 442 may regulate the speed based on a fluid discharge pressure of the system, in order to maintain a desired working pressure. In one implementation of the fire suppression system 400, when acting as a control component communicatively coupled to the communication network 434, the pressure governor 442 can be configured to adjust the engine speed to an appropriate level (e.g., set point or range) when it receives data indicative of an appropriate supply of fluid being available for the system (e.g., intake valve open and water flowing into intake).

Further, the pressure governor 442 can be configured to decrease engine speed, or maintain a mode, depending on whether or not the main pump 408 is pressurized (e.g., from the tank to pump valve 410). In this way, for example, responses to pressure fluctuation during a system fluid source transfer to a new source can be ignored, or an allowable fluctuation range can be dynamically modified based on a pending transfer operation. Additionally, the pressure governor 442 can be configured to maintain or reduce engine speed, and adjust control timing ranges based on a predicted time until the fluid storage tank 412 is empty. For example, when data is available that is indicative of information from a tank to pump valve 410, intake valve 404 and water level sensor (e.g., 316 of FIG. 3), the pressure governor 442 can maintain or reduce engine speed, and adjust control timing pending coupling to an alternate fluid source (e.g., water source 428). As another example, data indicative of inlet pressure, and use of historical system operation data that the system is drafting from a portable pond being refilled by a tender at intervals (e.g., and/or also refilling the water storage tank in the case of two or more tenders, the engine speed can be controlled in expectation of a pending fluid supply event as the situation dictates).

In one implementation, the pressure governor 442 can utilize state data (e.g., from the communication network 434, or one or more internal sensors) that identifies a current demand for flow at a discharge point; a desired flow rate setting at a discharge point; a desired fluid pressure setting at a discharge point; fluid inlet pressure (e.g., sufficient, not sufficient); a mode of operation of discharge valves 418 (e.g., auto, manual, working outside viable modulation range (80%<valve position <20%)); fluid source valve 402 and/or intake valve 404 positions (e.g., such as wirelessly through a wireless network gateway device 420, or wired); state data about and intake relief valve 406 regarding an opened/closed state; pressure and/or flow at the fluid source valve 402 and/or intake valve 404; tank to pump valve 410 position; pressure and/or flow, or position from plurality of fire suppression components (e.g., pump outlet relief valve 422, priming pump 424, and/or discharge component 430 (e.g., nozzle, monitor etc.)) that comprise control components, and or fluid storage tank 412 level (e.g., from the level sensor 316 of FIG. 3). Additionally, the pressure governor 442 can provide state data (e.g., to the communication network 434) regarding the system flow (e.g., pressure and/or flow rate); and/or current amount of flow capacity being utilized (e.g., percentage of total flow capabilities of system).

In FIG. 4, the example implementation of the fire suppression system 400 can comprise a drain valve 444. A drain valve 444 can be configured to open a line to allow fluid to drain from the system. In one implementation of the fire suppression system 400, when acting as a control component communicatively coupled to the communication network 434, the drain valve 444 can be configured to automatically open when a first desired condition is met, such as when all of the intake and/or discharge valves are close; and close when second desired condition is met, such as when any of the intake and/or discharge valves are open. In this way, for example, draining system lines can mitigate a potential for the fluid to freeze in the system and cause damage. In one implementation, the drain valve 444 can utilize state data (e.g., from the communication network 434, or one or more internal sensors) that identifies a position of valves in the system. Additionally, the drain valve 444 can provide state data (e.g., to the communication network 434) regarding the position of the drain valve (e.g., open, closed).

In FIG. 4, the example implementation of the fire suppression system 400 can comprise a fluid additive (e.g., foam) metering valve 446. A fluid additive metering valve 446 can be configured to adjust a fluid additive flow from a fluid additive source 484 into the system, for example, to allow a predetermined amount of foam into a system line based at least on a desired mixture rate. In one implementation of the fire suppression system 400, when acting as a control component communicatively coupled to the communication network 434, the fluid additive metering valve 446 can be configured to automatically adjust a valve position to maintain a desired fluid additive mixture rate, for example, based on an actual discharge flow of the system, or individual or paired discharge lines. In this way, for example, the foam system can be set to a desired mix rate, and it can maintain this rate as site and/or operational conditions change. In one implementation, the fluid additive metering valve 446 can utilize state data that identifies the desired mix rate; a position of discharge valves; and/or the flow (e.g., pressure and/or flow rate) in the line leading to the fluid additive discharge. Additionally, the fluid additive metering valve 446 can provide state data (e.g., to the communication network 434) regarding the position of the metering valve; and/or the actual fluid additive mix rate applied.

In FIG. 4, the example implementation of the fire suppression system 400 can comprise a compressed air foam system (CAFS) valve 448. A CAFS valve 448 can be configured to control a flow of air from a pressurized air tank 482 (e.g., or other air source) into a foam discharge system, for example, to generate foam at or prior to discharge. In one implementation of the fire suppression system 400, when acting as a control component communicatively coupled to the communication network 434, the CAFS valve 448 can be configured to automatically open to release air when water is flowing through the foam discharge system; and to close when the foam discharge system is non-operational. In one implementation, the CAFS valve 448 can utilize state data that identifies whether fluid is flowing through the foam line. Additionally, the CAFS valve 448 can provide state regarding the position of the valve.

In FIG. 4, the example implementation of the fire suppression system 400 can comprise a pump cooling valve 450. A pump cooling valve 450 can be configured to control fluid circulation around the main pump 408, for example, to draw excess heat away from the pump. In one implementation of the fire suppression system 400, when acting as a control component communicatively coupled to the communication network 434, the pump cooling valve 450 can be configured to automatically open and close to provide cooling to the pump based at least upon a water temperature in the pump. In this way, for example, the pump cooling valve 450 can automatically maintain a desired pump temperature to improve an operational life of the pump, and to mitigate pump failure during a critical operation. In one implementation, the pump cooling valve 450 can utilize state data that identifies the pump temperature. Additionally, the pump cooling valve 450 can provide state regarding the position of the cooling valve.

In FIG. 4, the example implementation of the fire suppression system 400 can comprise an engine cooling valve 452. An engine cooling valve 452 can be configured to control fluid circulation around the system engine 480, for example, to draw excess heat away from the engine. In one implementation of the fire suppression system 400, when acting as a control component communicatively coupled to the communication network 434, the engine cooling valve 452 can be configured to automatically open and close to provide cooling to the system engine 480 based at least upon an engine temperature. In this way, for example, the engine cooling valve 452 can automatically maintain a desired engine temperature to improve an operational life of the engine, and to mitigate engine failure during a critical operation. In one implementation, the engine cooling valve 452 can utilize state data that identifies the engine temperature. Additionally, the engine cooling valve 452 can provide state regarding the position of the cooling valve.

In FIG. 4, the example implementation of the fire suppression system 400 can comprise an inline/bypass eductor 454. An inline/bypass eductor 454 can be configured to draw fluid additive (e.g., foam) from a fluid additive source 486, such as a tank or bucket, into a fluid additive discharge line using a vacuum (e.g., using a venturi system). In one implementation of the fire suppression system 400, when acting as a control component communicatively coupled to the communication network 434, the inline/bypass eductor 454 can be configured to automatically monitor inlet and outlet pressure of the eductor to determine whether the pressures are sufficient to provide the vacuum to the fluid additive line. Further, the inline/bypass eductor 454 can be configured to automatically request (e.g., command) increased flow (e.g., pressure) from the system to accommodate provision of the vacuum to the line; and/or alert an operator of the pressure deficiency. In this way, for example, the inline/bypass eductor 454 can automatically determine whether it is functioning correctly, thereby providing the desired amount of fluid additive, or alerting the operator that the fluid additive discharge may not be operating as desired. In one implementation, the inline/bypass eductor 454 can utilize state data that identifies the inlet pressure to the eductor; and/or the discharge pressure from the eductor. Additionally, the inline/bypass eductor 454 can provide state regarding whether the bypass valve is open or closed; and/or a required flow pressure to effectively operate.

In FIG. 4, the example implementation of the fire suppression system 400 can comprise a monitor to monitor control valve 456. A monitor to monitor control valve 456 can be configured to control a flow of fluid out of a monitor 432. In one implementation of the fire suppression system 400, when acting as a control component communicatively coupled to the communication network 434, the monitor to monitor control valve 456 can be configured to automatically regulate its valve's position to maintain a desired flow (e.g., set point or range). Further, the monitor to monitor control valve 456 can be configured to automatically limit flow under operational conditions where an available flow is less than (e.g., or greater than) a discharge flow demand for the system; and/or limit flow when an aerial discharge is extended, for example, in order to provide safer operational conditions for the aerial system. In this way, for example, by automating the flow regulation and/or predictive flow limitation, which is typically performed manually by the operator, the operator is freed to perform other operational tasks. In one implementation, the monitor to monitor control valve 456 can utilize state data that identifies a demand for flow; the desired flow (e.g., rate and/or pressure); current available incoming fluid supply; and/or current discharge flow demand from all operating discharges. Additionally, the monitor to monitor control valve 456 can provide state regarding its valve position; mode of operation (e.g., manual or automatic); flow rate; flow pressure; whether a flow set point has been attained; and/or a flow limit, based at least on a desired operational rule set.

In one aspect, an example fire suppression system (e.g., 300 of FIG. 3, 400 of FIG. 4) may be operated in a particular sequence. In one implementation, operation of an example fire suppression system may comprise initiating pump operation (e.g., turning on the pump. Further, in this implementation, the tank to pump valve may subsequently (e.g., or concurrently) be opened, for example, where the pump is engaged, and discharge valves are in a closed position. In one implementation, a pump to tank valve 414 may initially be partially opened to provide recirculation cooling for the engine and/or pump. Additionally, in this implementation, one or more discharge valves may be opened, such as when a nozzle operator calls for flow. At this time, for example, the pump to tank valve 414 may be closed if previously opened for recirculation cooling. A water source line may be coupled between a water source (e.g., hydrant or pool) and an intake valve. The water source can be opened, and air bled from the intake line, such as at network controllable air bleeder valve 405 associated with the intake valve 404. Upon determining that the water supply intake pressure is sufficient, in this implementation, the system intake valve can be opened. Upon determining that the intake pressure is sufficient, the tank to pump valve can be close, and intake pressure can be monitored. In this implementation, at this point, various state conditions can be monitored and the system may adjust according to site conditions and operational conditions.

Figure 5:
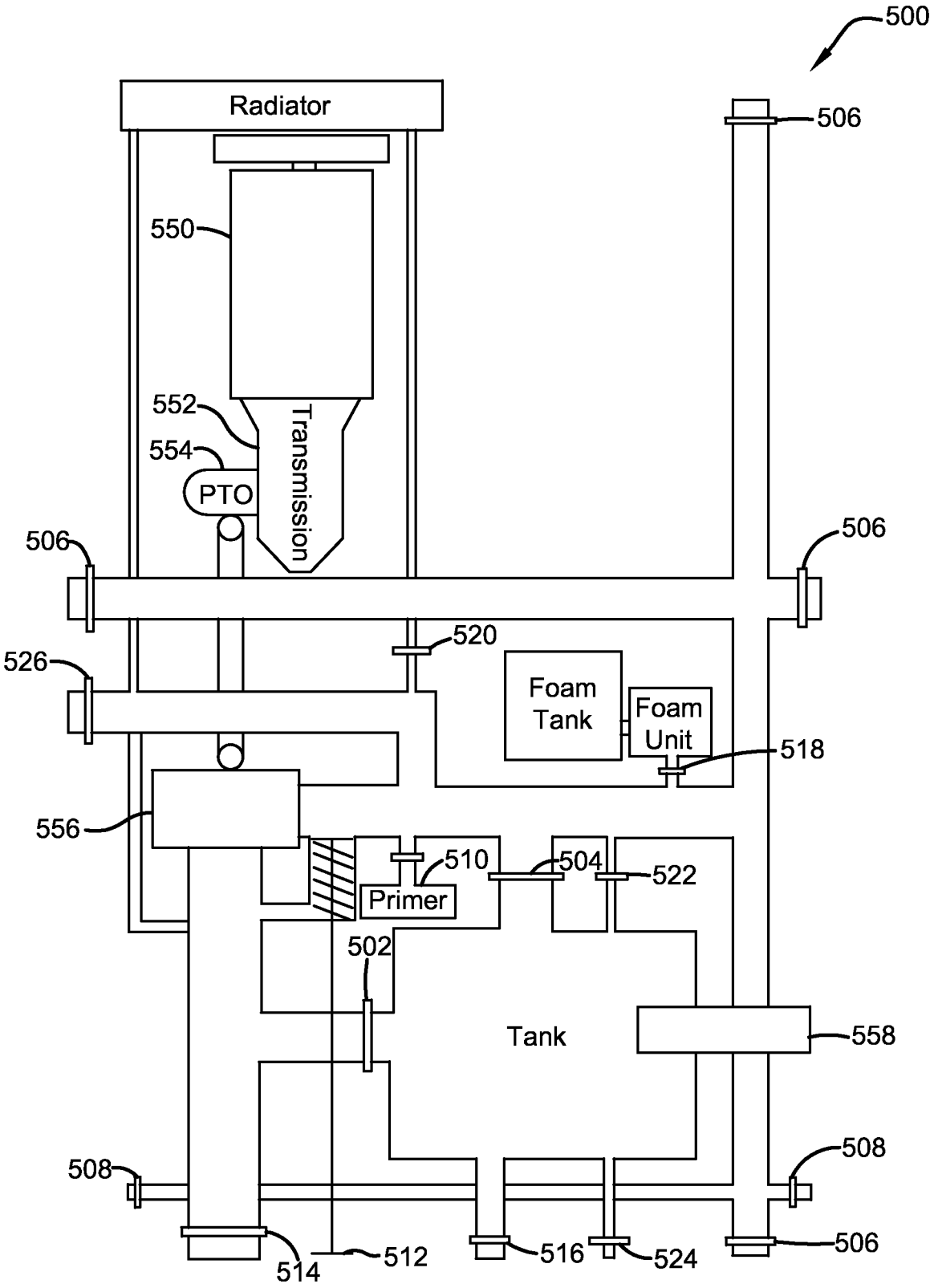
FIG. 5 is a schematic diagram illustrating an example implementation of one or more portions of one or more systems described herein.

FIG. 5 is a schematic diagram illustrating another example implementation 500 of one or more systems described herein. The example system 500, comprise an engine 550 (e.g., a vehicle engine) configured to provide motive power to one or more components of the system 500. Further, the system 500 can comprise a transmission 552 and power take off 554 configured to transmit the power generated by the engine 550 to the one or more components in the system 500. In this example, the system 500 can comprise a main pump 556, configured to provide fluid pumping power to the fluid distribution system, and a tank fill pump 558, configured to fill a source tank with fluid. In this example, the respective pumps 556, 558 may utilize the power transmitted by the power take off 554 (PTO) as a source of pumping power.

The example system 500, can comprise a plurality of fluid control components (e.g., comprising a valve), one or more of which can comprise control components communicatively coupled (e.g., wired or wirelessly) with a communications network (not shown). Further, the respective fluid control components can be configured to transmit state data (e.g., open, closed, partially open, flow rate, temperature, etc.) to the communications network, which may, in turn, be received by one or more of the other components coupled to the communications network (e.g., or to outside the system 500, such as to a remote display/input controller).

The example system 500 can comprise a tank to pump fluid controller 502, configured to control the flow of fluid out of the tank; and a pump to tank fluid controller 504, configured to control the flow of fluid in to the tank. Further, the example system 500 can comprise one or more overboard discharge flow controllers 506, configured to control flow to a discharge component (e.g., discharge manifold, nozzle, monitor, another discharge system, etc.). Additionally, the example system 500 can comprise a live reel fluid controller 508, a pump to primer fluid controller 510, a pressure relief fluid controller 512, and an overboard suction fluid controller 514. The example system 500 may also comprise a gravity drain fluid controller 516, a foam bypass fluid controller 518, an engine cooling fluid controller 520, a pump bypass fluid controller 522, a low volume gravity drain fluid controller 524, and a clean water discharge fluid controller 526. It will be appreciated that a plurality of other components related to fire suppression operations are anticipated as may be developed by those skilled in the art.

In one aspect, a distributed control network for a fire suppression system can comprise a local area data communications network (e.g., 334 of FIG. 3, 434 of FIG. 4). In this aspect, in one implementation, the local area data communications network can be configured to provide access to fire suppression operational data to respective control components coupled to the network. Further, in this implementation, the distributed control network can comprise a first fire suppression operation component (e.g., 302-318, 322, 324, 330, 336, etc. of FIG. 3), which may be configured to perform a first fire suppression operation (e.g., open a valve, discharge fluid, fill a tank, close a valve, operate a pump, etc.). Additionally, in this implementation, the first fire suppression operation component can comprise a first control component that is communicatively coupled with the network.

In one implementation, the first control component can be configured to identify a state of the first fire suppression operation component, for example, a position of a valve, operational conditions, sensor data, use data, user input information, etc. Further, the first control component can be configured to provide data indicative of the state of the first fire suppression operation component to the network, for example, by transmitting the identified state data to the coupled network. Additionally, the first control component can be configured to access data form the network that is indicative of a state of one or more other fire suppression operation components on the network; and modify the state of the first fire suppression operation based at least upon an indication from the data accessed from the network. That is, for example, data from another coupled component may indicate that a valve controlled by the first fire suppression operation component can be closed to improve operational pressure elsewhere; and that data can be used to move the valve from an open to a closed state.

In one implementation, in this aspect, the distributed control network can comprise a second fire suppression operation, which may be configured to perform a second fire suppression operation. Additionally, in this implementation, the second fire suppression operation component can comprise a second control component that is communicatively coupled with the network. The second control component can be configured to identify a state of the second fire suppression operation component, and to provide data indicative of the state of the second fire suppression operation component to the network. Further, the second control component can be configured to access data form the network that is indicative of a state of the first suppression operation component, and modify the state of the second fire suppression operation based at least upon an indication from the data from the first suppression operation component.

Figure 6A:
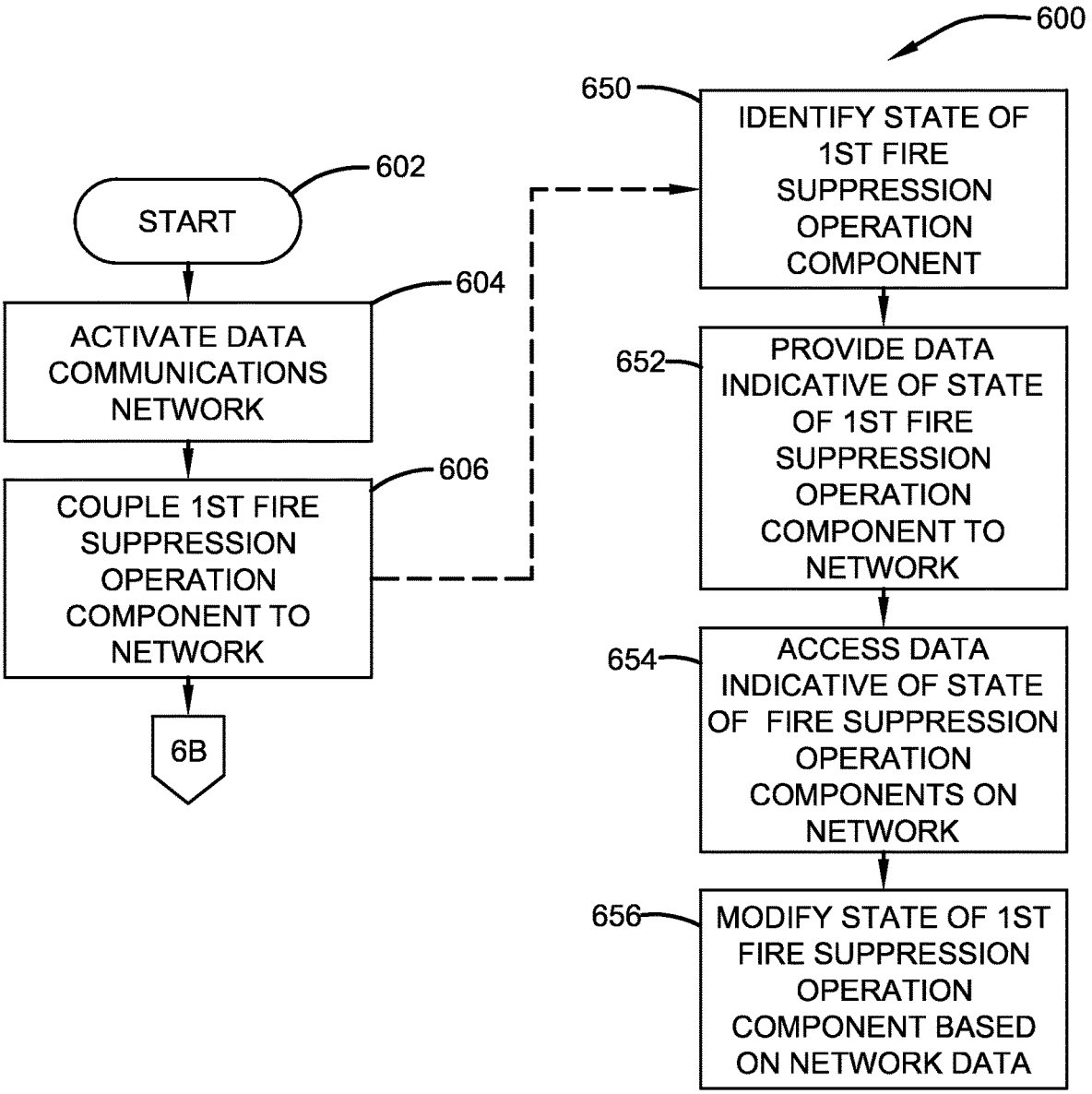
FIGS. 6A and 6B are flow diagrams illustrating an implementation of an exemplary method for utilizing a distributed network for fire suppression operations.
Figure 6B:
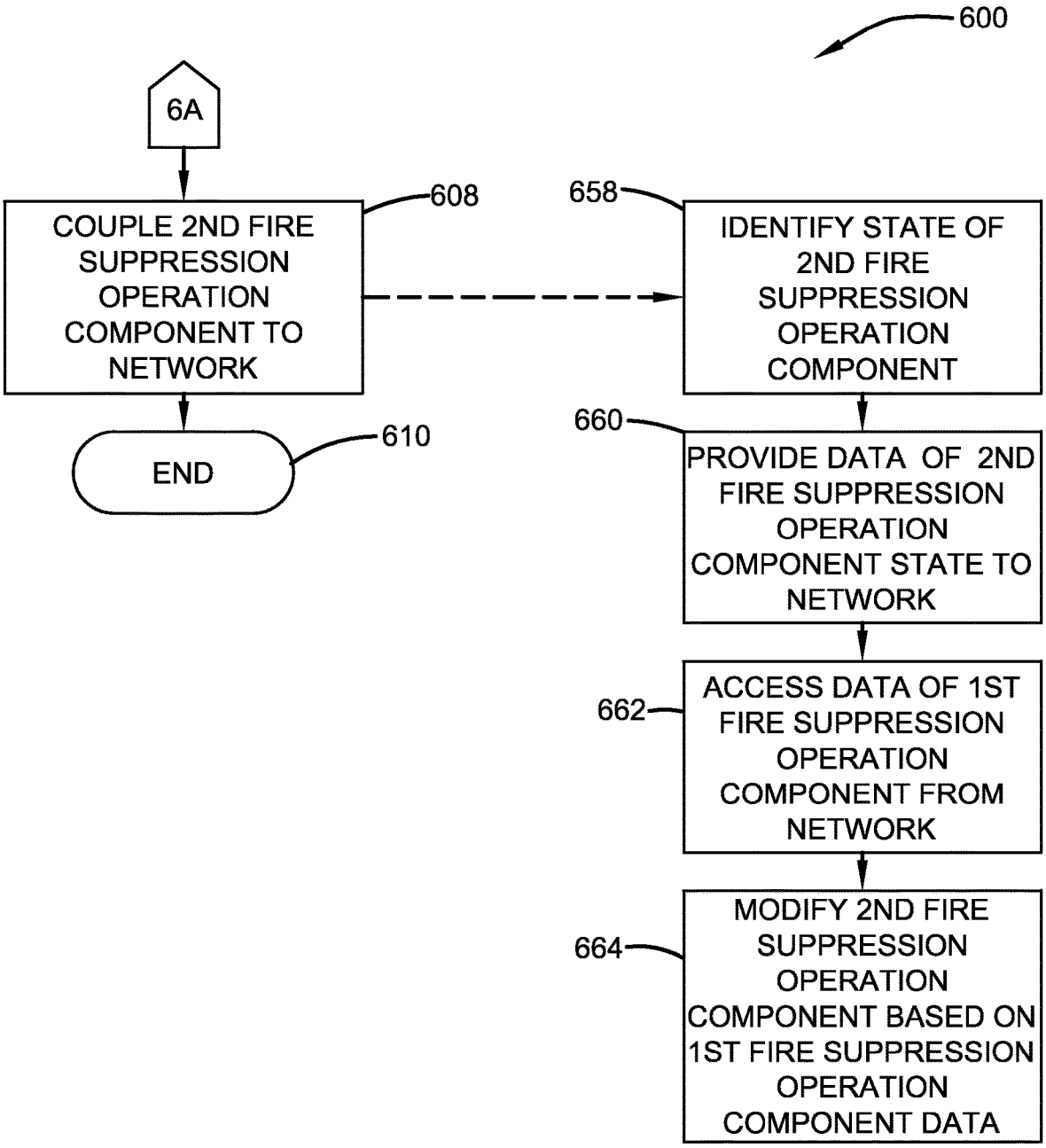

In one aspect, a method for utilizing one or more portions of the one or more systems described herein may be devised. FIGS. 6A and 6B are flow diagrams illustrating an exemplary method 600 for utilizing a distributed control network for a fire suppression system. The exemplary method 600 begins at 602. At 604, a data communications network can be activated, where the data communications network may be configured to provide access to fire suppression operational data to respective control components coupled to the network. At 606, a first fire suppression operation component can be operably coupled to the communication network. In this implementation, the first fire suppression operation component can be configured to perform a first fire suppression operation, such as opening a valve, discharging fluid, filling a tank, closing a valve, operating a pump, etc.

Further, in the exemplary method 600, the first fire suppression operation component can comprise a first control component communicatively coupled with the network, where the first control component may be configured to identify a state of the first fire suppression operation component, at 650. Additionally, the first control component may be configured to provide data indicative of the state of the first fire suppression operation component to the network, at 652. The first control component can also be configured to access data indicative of a state of one or more fire suppression operation components from the network, at 654, and modify the state of the first fire suppression operation based at least upon an indication from the data accessed from the network, at 656.

In one implementation, at 608, a second fire suppression operation component can be operably coupled to the communication network, where the second fire suppression operation component may be configured to perform a second fire suppression operation, and the second suppression operation component can comprise a second control component communicatively coupled with the network. In this implementation, the second control component may be configured to identify a state of the second fire suppression operation component, at 658. Additionally, the second control component may be configured to provide data indicative of the state of the second fire suppression operation component to the network, at 660. The second control component can also be configured to access data indicative of a state of first fire suppression operation component from the network, at 662, and modify the state of the second fire suppression operation based at least upon an indication from the data accessed from the network, at 664.

In this implementation, having operably coupled the second fire suppression operation component to the communication network, the exemplary method 600 ends at 610.

It will be appreciated that the one or more systems, described herein, are not limited merely to the implementations listed above. That is, it is anticipated that the example fire suppression systems can be configured to operably engage with additional or alternate control components, such as devised by those skilled in the art. For example, another fire suppression control component may be devised that provides additional functionality to the fire suppression system (e.g., improves performance, and/or provides functionality for different conditions, such as different types of fires or situations). In this example, it is anticipated that the control component may be configured to communicatively couple with the example communication network, and operate in a distribute network, for example, transmitting state data to the network, and/or receiving state data from other control components engaged with the network.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Reference throughout this specification to "one implementation" or "an implementation" means that a particular feature, structure, or characteristic described in connection with the implementation is included in at least one implementation. Thus, the appearances of the phrases "in one implementation" or "in an implementation" in various places throughout this specification are not necessarily all referring to the same implementation. Furthermore, the particular features, structures, or characteristics may be combined in any suitable manner in one or more implementations. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising." Various operations of implementations are provided herein. The order in which some or all of the operations are described should not be construed as to imply that these operations are necessarily order dependent. Alternative ordering will be appreciated by one skilled in the art having the benefit of this description. Further, it will be understood that not all operations are necessarily present in each implementation provided herein.

What is claimed is:

1. Afire suppression system utilizing distributed control, comprising:

a communication network;

a first control component, communicatively coupled with the communication network, and configured to:

perform a first fire suppression operation;

transmit first fire suppression operation data to the communication network; and receive second fire suppression operation data from the communication network, the received second fire suppression operation data transmitted to the communication network from a second control component communicatively coupled with the communication network;

wherein the first control component comprises a first microcontroller that operably provides the first fire suppression operation data, and determines the first fire suppression operation; and the second control component, configured to:

perform a second fire suppression operation;

transmit the second fire suppression operation data to the communication network;

receive the first fire suppression operation data from the communication network; and alter the second fire suppression operation based at least upon the received first fire suppression operation data;

wherein the second control component comprises a second microcontroller that operably provides the second fire suppression operation data, and determines the alteration of the second fire suppression operation based at least upon the received first fire suppression operation data.

2. The system of claim 1, the first control component configured to alter the first fire suppression operation based at least upon the received second fire suppression operation data.

3. The system of claim 1, the first fire suppression operation data comprising a state of the first fire suppression operation, and the second fire suppression operation data comprising a state of the second fire suppression operation.

4. The system of claim 1, the first control component and second control component respectively comprising one or more of:

an interface connector configured to communicatively couple the control component to the communication network;

a communications link configured to communicate with the communication network;

an electronic control unit (ECU) configured to control one or more of an electrical system or subsystem in the control component;

one or more sensors configured to detect one or more of the environmental conditions and the operational conditions of the control component;

one or more actuators configured to actuate an operational component in the control component;

means for user input and/or user output; and means for operably coupling one or more peripherals;

wherein the first and second microcontrollers are respectively configured to perform an embedded application in the corresponding control component.

5. The system of claim 1, the first control component and second control component communicatively coupled with the communication network by one or more of:

a wired connection; and a wireless connection to a wireless network gateway device that comprises a communication connection to the communication network.

6. The system of claim 1, the first control component and second control component respectively comprising one of:

a fluid source supply control valve;

a system pump fluid intake valve; an intake pressure relief valve;

a fluid storage tank to pump valve;

a fluid storage tank level sensor;

a fluid storage tank refill valve;

a discharge pressure relief valve;

a discharge valve;

a discharge nozzle;

an intake air bleeder valve;

an aerial waterway valve;

a pressure governor;

a priming pump;

a drain valve;

a fluid additive metering valve;

an air flow intake valve;

a pump cooling valve;

an engine cooling valve;

a portable monitor;

an inline-bypass eductor;

a monitor;

a monitor control valve; and a command control device.

7. The system of claim 1, the communication network comprising a wireless network gateway device configured to communicate wirelessly between the communication network and the first control component engaged with the fire suppression system.

8. The system of claim 1, the first control component and second control component respectively configured to transmit the first fire suppression operation data and the second fire suppression operation data, respectively, to the communication network indicative of one or more of:

a state of the control component;

a system operational condition at the control component; and a desired system operational demand.

9. The system of claim 8, the system operational condition at the control component indicated by one or more of:

user input; and a sensor disposed at the control component.

10. The system of claim 9, the sensor configured to detect one or more of the following:

an environmental condition at the control component;

a condition of fluid at the control component; and a condition of the control component.

11. The system of claim 1, the first control component and second control component respectively configured to receive data from the communication network provided by a third control component, the received data from the third control component transmitted to the communication network from the third control component.

12. The system of claim 11, the first control component and second control component respectively configured to respond independently to the received data.

13. The system of claim 1, comprising a third control component configured to:

receive first fire suppression operation data from the communication network;

receive second fire suppression operation data from the communication network;

receive user input; and transmit third fire suppression operation data to the communication network, the third fire suppression operation data comprising data indicative of one or more of:

a request for an alteration of a control component based upon fire suppression operation data received from the communication network; and a request for an alteration of a control component based upon received user input.

14. The system of claim 1, wherein the communication network comprises a controller area network (CAN) bus.

* * * * *